US011840113B2

(12) United States Patent
Kuiken et al.

(10) Patent No.: US 11,840,113 B2
(45) Date of Patent: Dec. 12, 2023

(54) MARKER OPENER

(71) Applicant: Crayola LLC, Easton, PA (US)

(72) Inventors: Richard B Kuiken, Columbia, NJ (US); Craig Skinner, Nazareth, PA (US)

(73) Assignee: CRAYOLA LLC, Easton, PA (US)

( * ) Notice: Subject to any disclaimer, the term of this patent is extended or adjusted under 35 U.S.C. 154(b) by 0 days.

(21) Appl. No.: 17/541,377

(22) Filed: Dec. 3, 2021

(65) Prior Publication Data

US 2022/0176729 A1 Jun. 9, 2022

Related U.S. Application Data

(60) Provisional application No. 63/121,348, filed on Dec. 4, 2020.

(51) Int. Cl.
*B25B 27/14* (2006.01)
*B43K 13/00* (2006.01)

(52) U.S. Cl.
CPC ..... *B43K 13/005* (2013.01); *B25B 27/14* (2013.01)

(58) Field of Classification Search
CPC .... B67B 7/12; B67B 7/14; B67B 7/15; B67B 7/16; B67B 7/18; B67B 7/44; B01L 3/50825; B25B 27/0042; B43K 13/00; B43K 13/005; B43K 15/00
USPC ..... 29/426.5; 7/151, 166; 81/3.55, 3.48, 81/3.44
See application file for complete search history.

(56) References Cited

U.S. PATENT DOCUMENTS

2016/0166050 A1* 6/2016 Siedlack ..... A45F 5/10 7/105

FOREIGN PATENT DOCUMENTS

KR 20130077023 A * 12/2011

OTHER PUBLICATIONS

KR20130077023—Machine Translation (Year: 2011).*

* cited by examiner

*Primary Examiner* — Lee D Wilson
*Assistant Examiner* — Alberto Saenz
(74) *Attorney, Agent, or Firm* — STINSON LLP

(57) ABSTRACT

The present disclosure is directed to a marker opening device comprising at least one plug remover, at least one nib remover, and/or at least one cartridge remover. Also provided herein is a method of disassembling a marker using the marker opening device, the disassembly of the marker allowing for separation of the recyclable and non-recyclable components thereof.

15 Claims, 16 Drawing Sheets

MARKER OPENER

CROSS-REFERENCE TO RELATED APPLICATIONS

This application claims priority to Provisional Patent Application Ser. No. 63/121,348, filed on Dec. 4, 2020, which is incorporated herein by reference in its entirety.

FIELD

The present disclosure is directed to a marker opening device including a plug remover, a nib remover, and/or a cartridge remover.

BACKGROUND

Color markers are very popular amongst children and adults for use in creating colored pictures, posters, and a variety of other arts and crafts projects. Referring to FIGS. 1A and 1B, commercially available markers 10 generally include a cylindrical or tubular body or barrel 12 having a drawing end 14 and an open end 16. The drawing end 14 receives a nib 18 (e.g., bullet nib, brush nib, chisel nib, flat nib, stamping nib, etc.). The nib 18 may also be of varying sizes (e.g., broad, semi broad, fine, super fine, etc.). The different-sized nib 18 will generally have correspondingly-sized barrels 12. The open end 16 receives an ink reservoir or cartridge (not shown). The nib 18 includes a writing end and a contact end opposite the writing end which engages the reservoir. The reservoir generally includes an element which contains the ink, or ink moves within the reservoir (i.e., free ink systems). The ink flows from the reservoir through the nib 18 when the writing end contacts a writing surface.

An end plug 26 is received within the open end 16 of the barrel 22. The end plug 26 seals the open end 16 of the barrel 12 containing the ink reservoir. Some markers 10 may comprise an end plug 26 having ledge 30. Marker 10 may also include a cap (not shown) generally placed over nib 18 to prevent the ink reservoir from drying out and to prevent unwanted markings between use of the marker 10. As an additional feature to protect against evaporation of water-based ink within the ink reservoir, and in some instances to secure plug 26 into child-proof engagement with barrel 12, plug 26 may be welded, heat-sealed, glued, or otherwise tightly engaged against open end 16 of barrel 12 so that a consumer is prevented from removing plug 26 without the use of excessive force. Similarly, the nib 18 is tightly secured onto barrel 12 so as to also prevent the unnecessary and/or unintended removal of the nib 18, such as by a child.

Typically, the marker barrel 12, end plug 26, and cap are generally made from recyclable plastic, whereas the nib 18 and ink reservoir or cartridge are made from non-recyclable materials (e.g., polyester fibers contaminated with ink). Therefore, in order to recycle the barrel, plug, and cap, these parts must first be separated from the non-recyclable nib and cartridge.

SUMMARY

The present disclosure is directed to a marker opening device comprising a body having an upper surface, a lower surface, and an interior surface, the body including at least one plug remover comprising: a plug remover opening defined by the interior surface, the plug remover opening sized to receive a plug of a marker; and a well at an edge of the opening defining a well surface; wherein the plug remover is configured to receive the plug of the marker in the plug remover opening, such that when the marker is angled in the plug remover opening relative to the body of the marker opening device, a portion of the outer surface of the plug is in abutting engagement with the well surface.

In another embodiment, the marker opening device comprises a plug remover comprising an upper edge well at an upper edge of the opening defining an upper well surface and a lower edge well at a lower edge of the opening defining a lower well surface, wherein the upper edge well opposes the lower edge well; and wherein the plug remover is configured to receive the plug of the marker in the plug remover opening, such that when the marker is angled in the plug remover opening relative to the body of the marker opening device, a portion of the outer surface of the plug is in abutting engagement with one of the upper well surface and the lower well surface, and a portion of a barrel of the marker is in abutting engagement with the other of the upper well surface and the lower well surface.

Also provided herein is a marker opening device comprising: a body having an upper surface, a lower surface, and an interior surface, the body including at least one plug remover and at least one nib remover; wherein the at least one plug remover comprises: a plug remover opening defined by the interior surface, the plug remover opening sized to receive a plug of a marker, wherein the plug remover is configured to receive the plug of the marker in the opening, such that when the marker is angled in the plug remover opening relative to the body of the marker opening device, a portion of the plug is in abutting engagement with the interior surface; and wherein the at least one nib remover comprises: a nib remover opening defined by the interior surface, the nib remover opening sized to receive a nib of the marker; wherein at least one of an upper edge of the nib remover opening and a lower edge of the nib remover opening is angled so that a width of the nib remover opening decreases across a length of the nib remover opening to define a narrow opening having a width less than the diameter of the nib of a marker.

The present disclosure is also directed to a marker opening kit comprising: at least one plug remover comprising: an upper surface, a lower surface, and an interior surface; a plug remover opening defined by the interior surface, the opening sized to receive a plug of a marker; wherein the plug remover is configured to receive the plug of the marker in the opening such that when the plug is angled in the plug remover opening relative to a longitudinal axis of the plug remover, a portion of the plug is in abutting engagement with the interior surface of the plug remover; at least one nib remover comprising: an upper surface, a lower surface, and an interior surface; a nib remover opening defined by the interior surface, the opening sized to receive a nib of the marker; wherein at least one of the upper edge of the nib remover opening and a lower edge of the nib remover opening is angled so that a width of the nib remover opening decreases across a length of the nib remover opening to define a narrow opening having a width less than the diameter of the nib of a marker.

Other objects and features will be in part apparent and in part pointed out hereinafter.

BRIEF DESCRIPTION OF THE DRAWINGS

Corresponding reference characters indicate corresponding parts throughout the drawings.

DETAILED DESCRIPTION

Figure 1A:
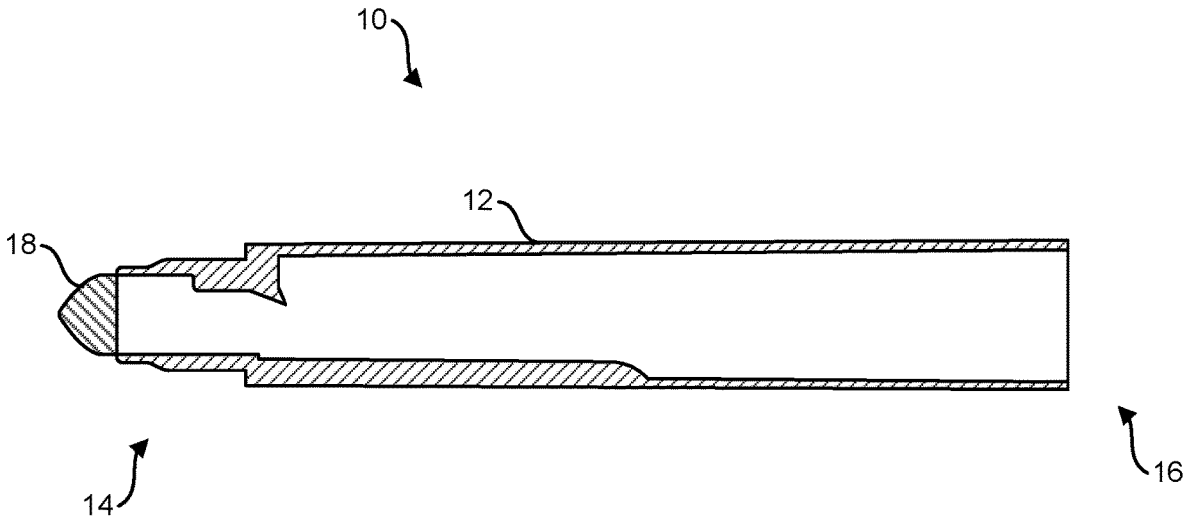
FIG. 1A is a cross-section of a barrel and nib of a standard broad line marker, which can be used in the marker opening device of the present disclosure.
Figure 1B:
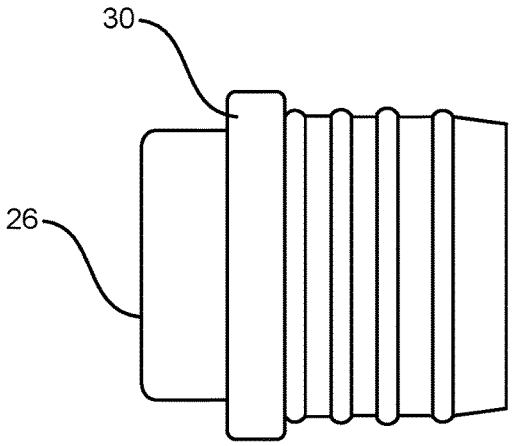
FIG. 1B is a side view of an end plug of a standard broad line marker, which can be used in the marker opening device of the present disclosure
Figure 1C:
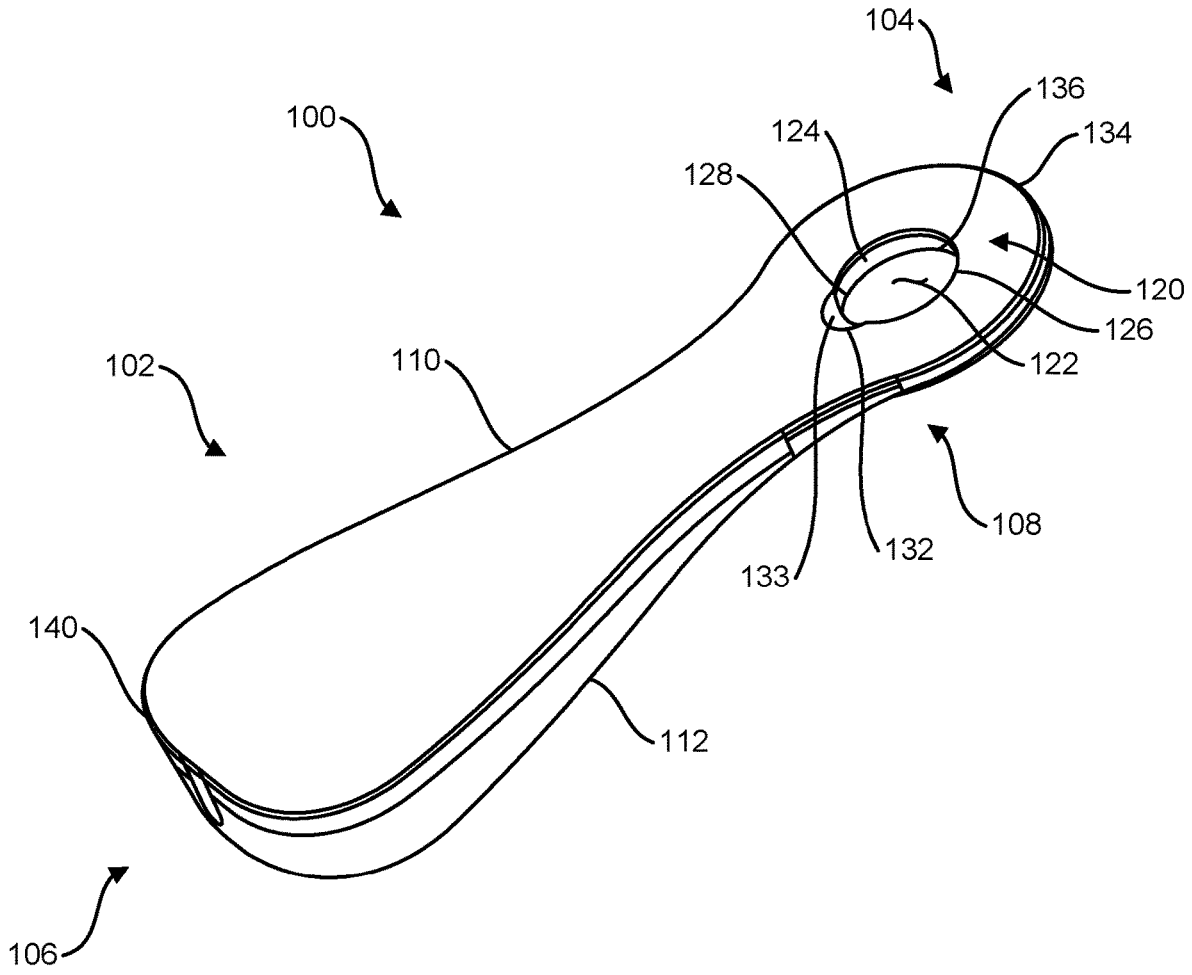
FIG. 1C is a perspective view of an embodiment of the marker opening device containing a plug remover.
Figure 2:
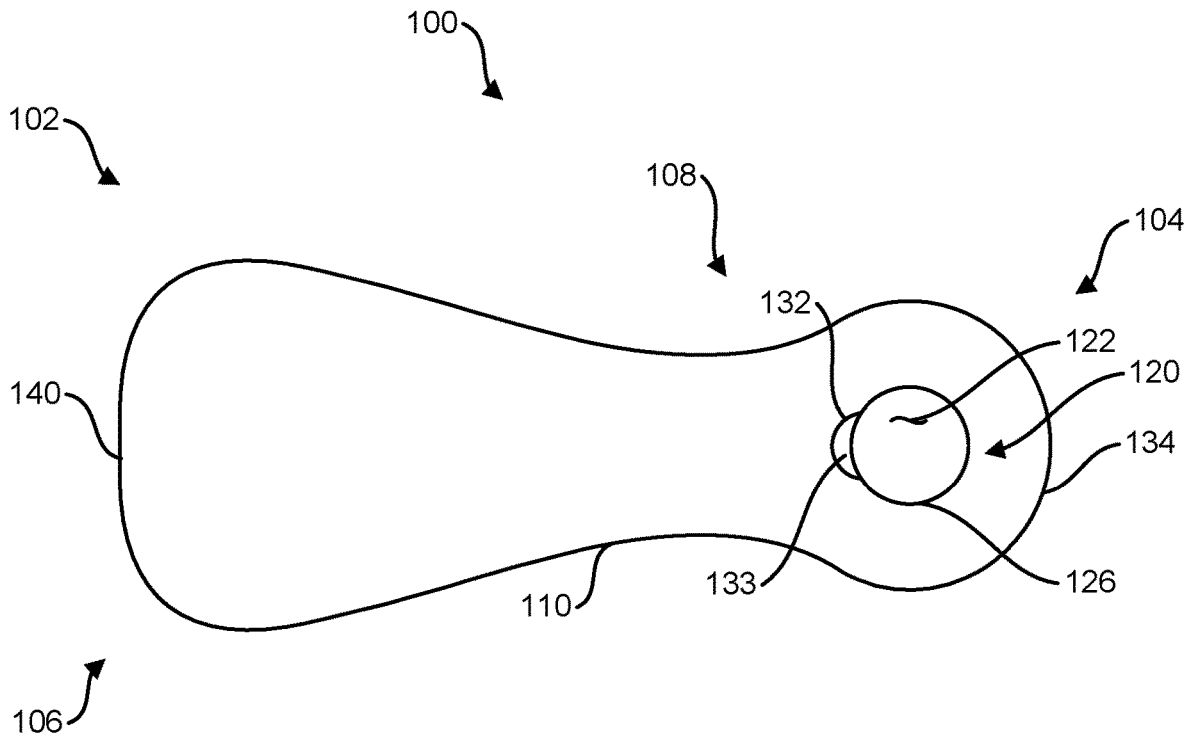
FIG. 2 is a top view of the marker opening device.
Figure 3:
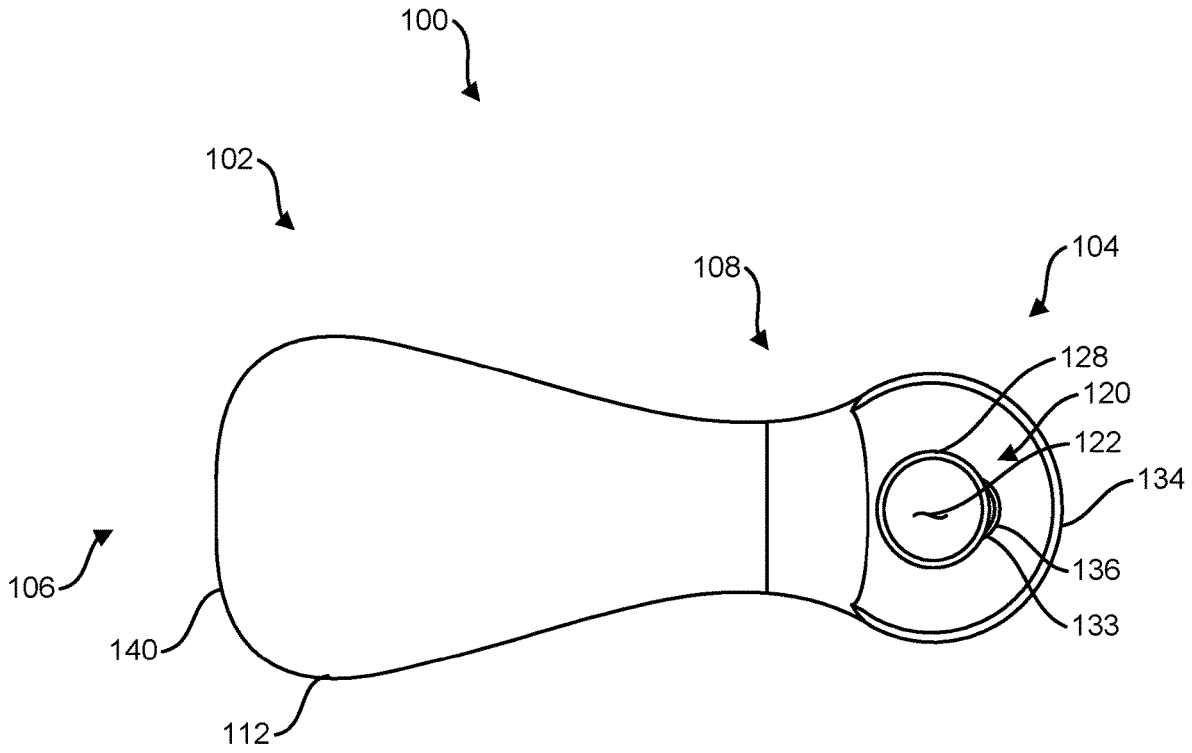
FIG. 3 is a bottom view of the marker opening device.
Figure 4A:
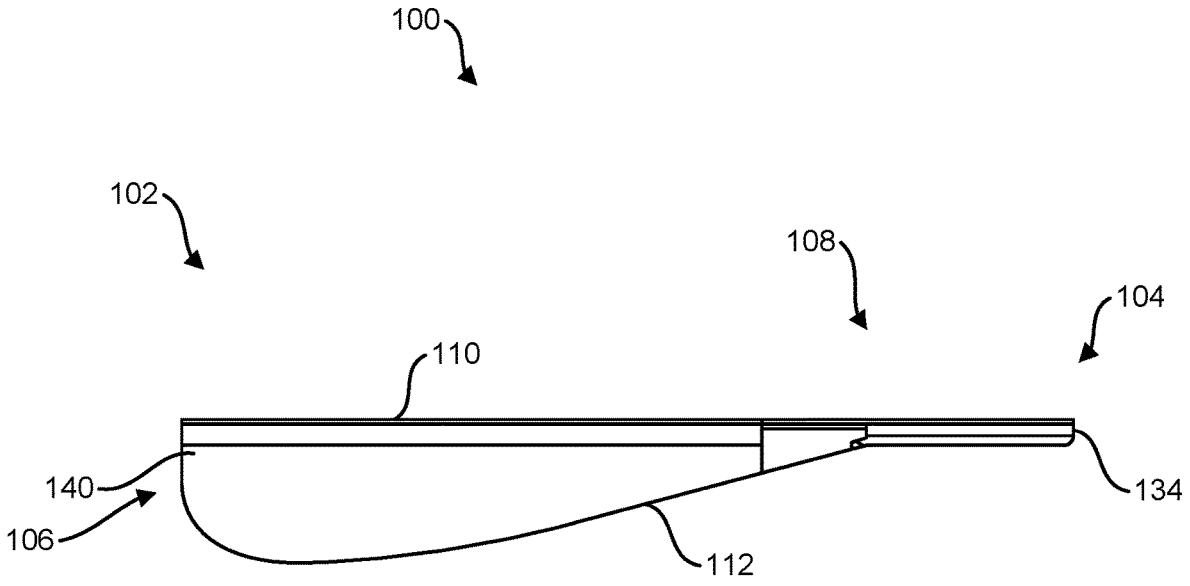
FIG. 4A is a side view of the marker opening device.
Figure 4B:
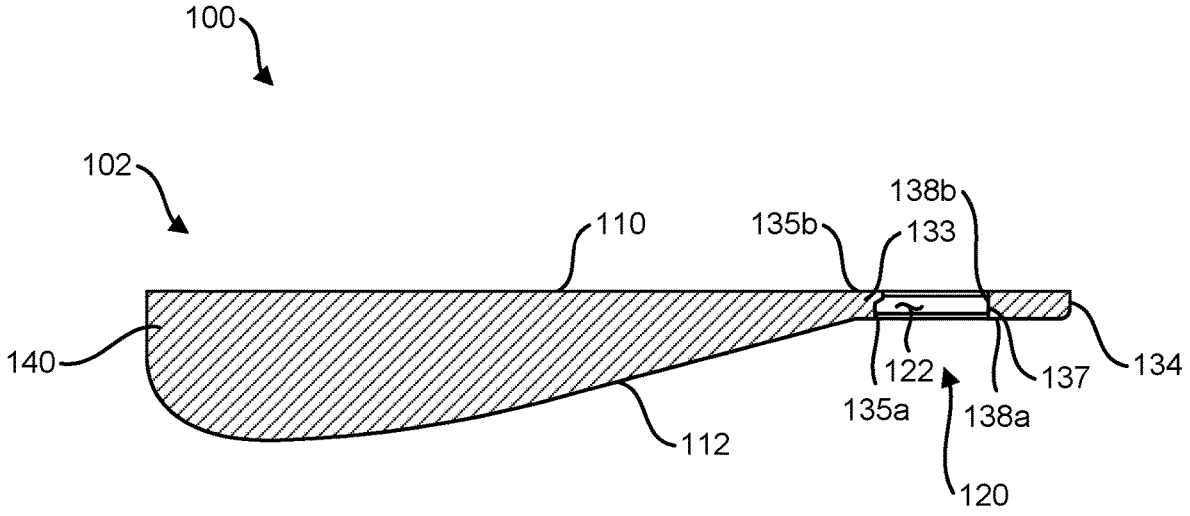
FIG. 4B is a cross-section of the marker opening device.

The present disclosure is related to a marker opening device intended to facilitate the separation of the recyclable plastic barrel and plug of the marker from the non-recyclable tip (nib) and ink cartridge.

In one embodiment, as shown in FIGS. 1C to 6, the marker opening device 100 comprises a body 102. The body 102 generally comprises a first portion 104, a second portion 106, and an intermediate portion 108. The body 102 also generally contains an upper surface 110, a lower surface 112, and an interior surface 124. The upper surface 110 and lower surface 112 of the body 102 can generally be flat. Alternatively, the upper surface 110 of the body can be flat and the lower surface 112 of the body 102 can be ergonomically shaped, e.g., the lower surface 112 of the first portion 104 of the body 102 can be flat and the lower surface 112 of the second portion 106 of the body 102 can generally be bulbous or curved to provide an ergonomic surface for a user's hand (FIG. 4A). It will be understood by the skilled person that the terms "upper," "lower," and any other term referencing the relative location of components and structure of the marker opening device are described in relation to the orientation of the marker opening device as used.

The device 100 can be constructed of any suitable material, for example, plastic, metal, wood, and the like. The device 100 can be constructed by 3-D printing, extruding, molding, or any other suitable process known to the skilled person. The device 100 can also be constructed by stamping or machining, which is preferable for devices 100 made of wood or metal.

The first portion 104 of the device 100 contains a plug remover 120. The interior surface 124 of plug remover 120 defines an opening 122 that is sized and shaped according to the type of marker intended for its use. For example, a plug remover 120 intended for a standard broad line marker has an opening 122 with a diameter that is greater than the plug of the broad line marker such that the plug can be inserted through the opening, and in some embodiments is greater than the barrel of the broad line marker such that at least a portion of the upper barrel can also be inserted through the opening. In the exemplary embodiments shown, the size of the opening 122 corresponds with that of the marker intended for its use such that when the plug and optionally a portion of the barrel is inserted into the opening and moved to an angled position, a portion of the outer surface of the plug (typically, an outer portion of the plug above ledge 30) is positioned in abutting engagement with interior surface 124. At least about 10% in one embodiment, at least about 25% in another embodiment, and at least about 40% in a further embodiment, of the circumference of the plug is in abutting engagement with interior surface 124. It is understood that opening 122 for a standard broad line marker (which typically has a barrel diameter of approximately 0.6 inches (15.24 millimeters) and a plug diameter of approximately 0.5 inches (12.7 millimeters)) would be larger than opening 122 for a fine line (which typically has a barrel diameter of approximately 0.4 inches (10.16 millimeters) and a plug diameter of approximately 0.3 inches (7.62 millimeters)) or super fine line marker. Alternatively, the plug remover 120 can be universally sized to remove a number of different sizes of plugs.

Figure 10:
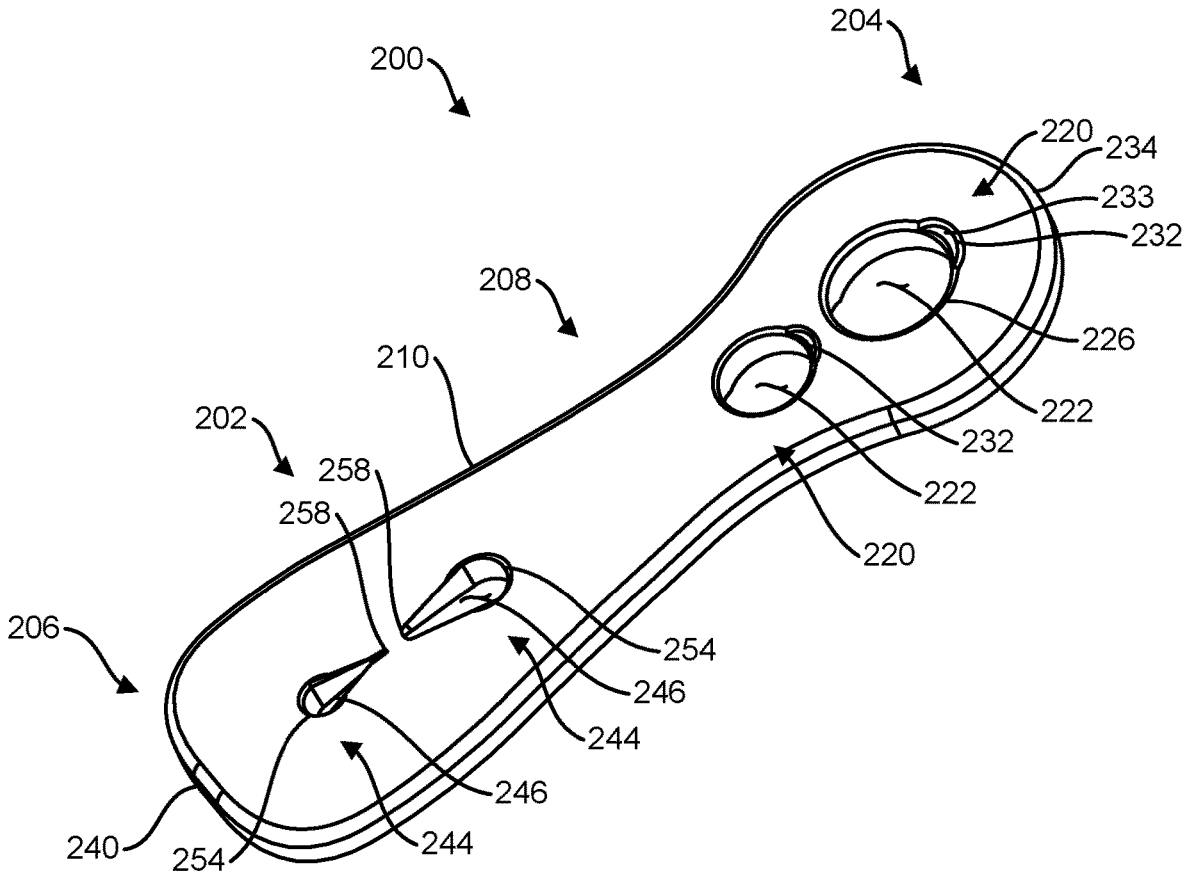
FIG. 10 is a perspective view of another embodiment of the marker opening device containing multiple plug removers and multiple nib removers.

As shown in the figures, opening 122 is generally circular in shape to correspond with the round shape of the marker, although it will be understood by the skilled person that any shape can be used according to the shape of the marker plug intended to be removed. In various embodiments, multiple plug removers 120 are located in the first portion 104 of the device 100 (see FIGS. 10 and 11). For example, the device 100 can contain a plug remover 120 intended for broad line markers, a plug remover 120 intended for fine line markers, and a plug remover 120 intended for super fine line markers, or any combination thereof, or any combination of sizes and shapes of plug removers, as desired.

The opening 122 is defined by interior surface 124 and contains an upper edge 126 at the upper surface 110 of the device 100 and a lower edge 128 at the lower surface 112 of the device 110. The upper edge 126 and/or lower edge 128 can contain a well 132, 136 (e.g., a depression or chamfer). The opening 122 can contain any number of desired wells, such as, for example, one well, two wells, etc. Preferably, the opening 122 contains two wells, with one well being on the upper edge 126 of the opening 122 and the other well being on the lower edge 128 of the opening 122, and wherein the two wells oppose each other on opposite sides of the opening. In the embodiment illustrated in FIGS. 1C to 4B, the upper edge 126 contains a first well 132 at the portion of the interior surface 124 of the opening 122 closest to a second end 140 of the device 100, and the lower edge 128 contains a second well 136 at the portion of the interior surface 124 closest to a first end 134 of the device 100. In the embodiment illustrated in FIGS. 5 and 6, the upper edge 126 contains a first well 132 at the portion of the interior surface 124 of the opening 122 closest to the first end 134 of the device 100, and the lower edge 128 contains a second well 136 at the portion of the interior surface 124 of the opening 122 closest to a second end 140 of the device 100.

First well 132 is configured to receive a portion of the outer surface of the plug of the marker (typically, the outer surface of the plug above ledge 30) when the marker is moved to an angled position within opening 122. In this angled position, a portion of the outer surface of the plug is in abutting engagement (direct contact) with upper well surface 133 defined by first well 132. First well 132 has inner end 135*a* aligned with the edge of the opening 122 and outer end 135*b* where first well 132 meets the upper surface 110 of body 102 (see FIG. 4B). First well 132 has a shape and circumference that generally corresponds to the shape and circumference of the plug. Upper well surface 133 is sloped downward from outer end 135*b* to inner end 135*a* to define an angle relative to the upper surface 110 of the body 102 (for example, at least about 20 degrees or at least about 40 degrees). In this manner, the well 132 cradles a portion of the plug such that the outer surface of the plug is in abutting engagement (direct contact) with the well surface 133 when the marker is moved to an angled position. At least about 10% in one embodiment, at least about 25% in another embodiment, and at least about 40% in a further embodiment, of the circumference of the plug (e.g., the circumference of the plug above the ledge 30) is in abutting engagement with (or encapsulated by) the well surface 133. Typically, the upper well surface 133 has a diameter that is approximately equal to the diameter of the plug intended to be removed. In some embodiments, the first well surface 133 has a length (extending from inner end 135*a* to outer end 135*b*) that is substantially the same as the corresponding length of the plug.

Second well 136 is configured to receive a portion of the outer surface of the barrel of the marker when the marker is moved to an angled position within opening 122. In this angled position, a portion of the outer surface of the barrel is in abutting engagement (direct contact) with lower well surface 137 defined by second well 136. Second well 136 has an inner end 138*a* aligned with the edge of the opening 122 and an outer end 138*b* where second well 136 meets the lower surface 112 of body 102 (see FIG. 4B). Second well 136 has a shape and circumference that generally corresponds with the shape and circumference of the barrel. Lower well surface 137 is sloped upward from outer end 138*b* to inner end 138*a* to define an angle relative to the lower surface 112 of the body 102 (for example, at least about 20 degrees or at least about 40 degrees). In this manner, the well 136 cradles a portion of the barrel such that the outer surface of the barrel is in abutting engagement (direct contact) with the well surface 137. At least about 10% in one embodiment, at least about 25% in another embodiment, and at least about 40% in a further embodiment, of the circumference of the barrel is in abutting engagement with (or encapsulated by) the well surface 137. Typically, the lower well surface 137 has a diameter that is approximately equal to the diameter of the barrel intended to be removed.

In this manner, different portions of the marker are cradled by the first well 132 and second well 136 in order to supply sufficient leverage to pry off the end plug. This mechanism is in contrast to other types of openers that supply leverage through inserting an edge of an opening defined by the opener between the objects intended to be separated and applying an upward or downward lever force.

Figure 5:
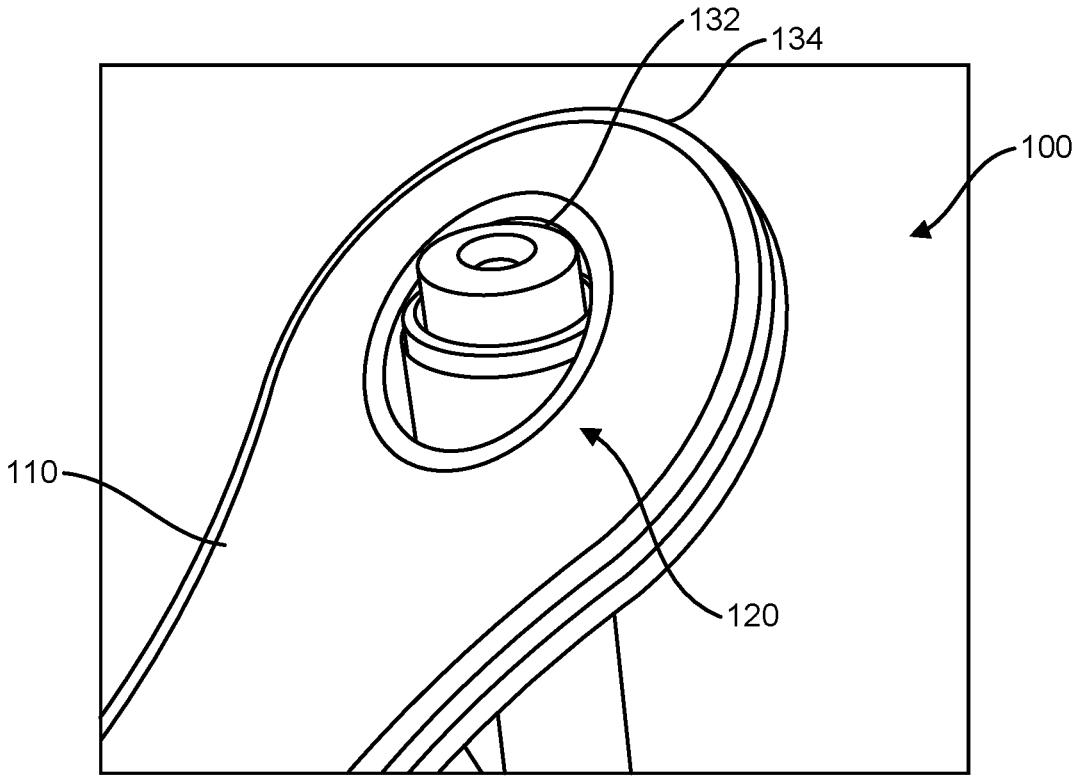
FIG. 5 is an image of a marker inserted in the plug remover of the marker opening device from the top of the device.
Figure 6:
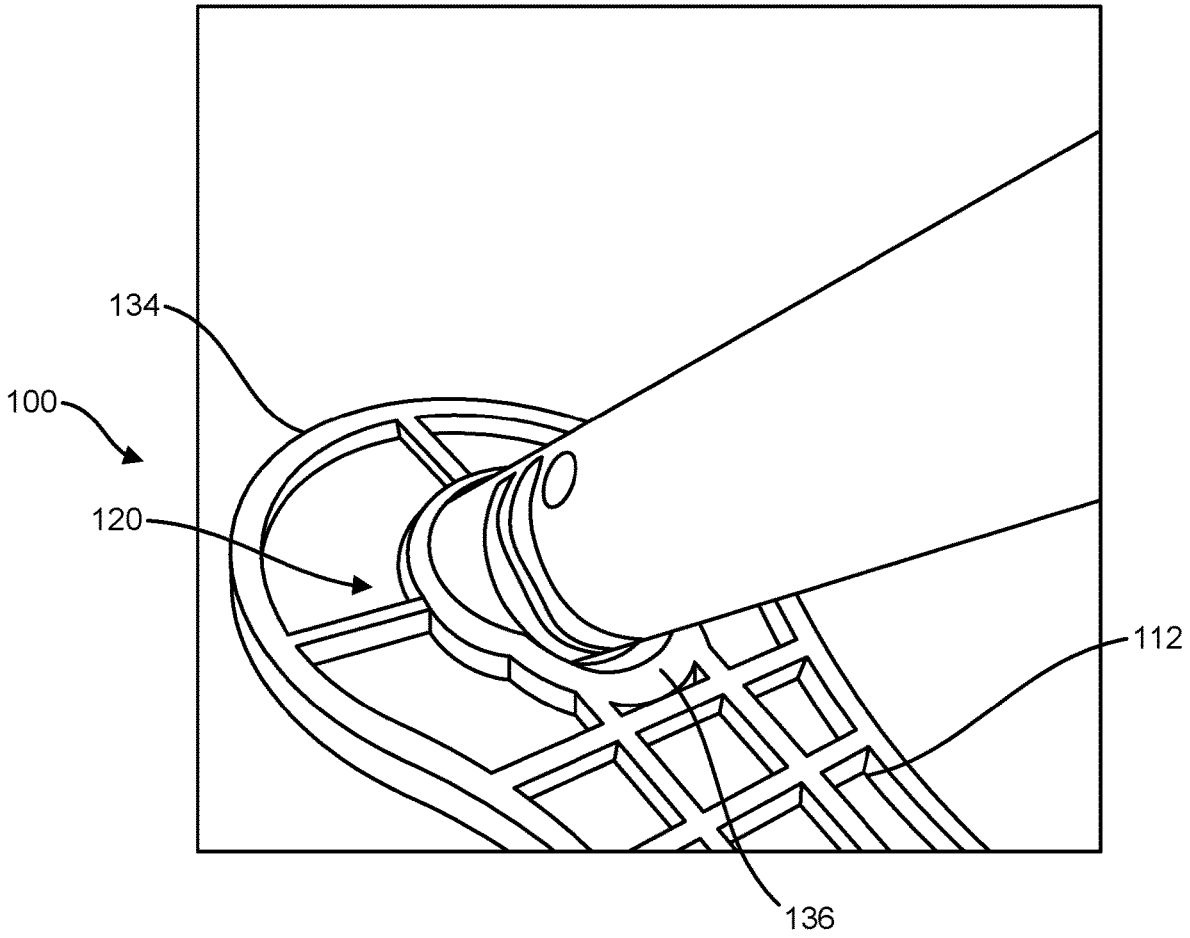
FIG. 6 is an image of a marker inserted in the plug remover of the marker opening device from the bottom of the device.
Figure 7:
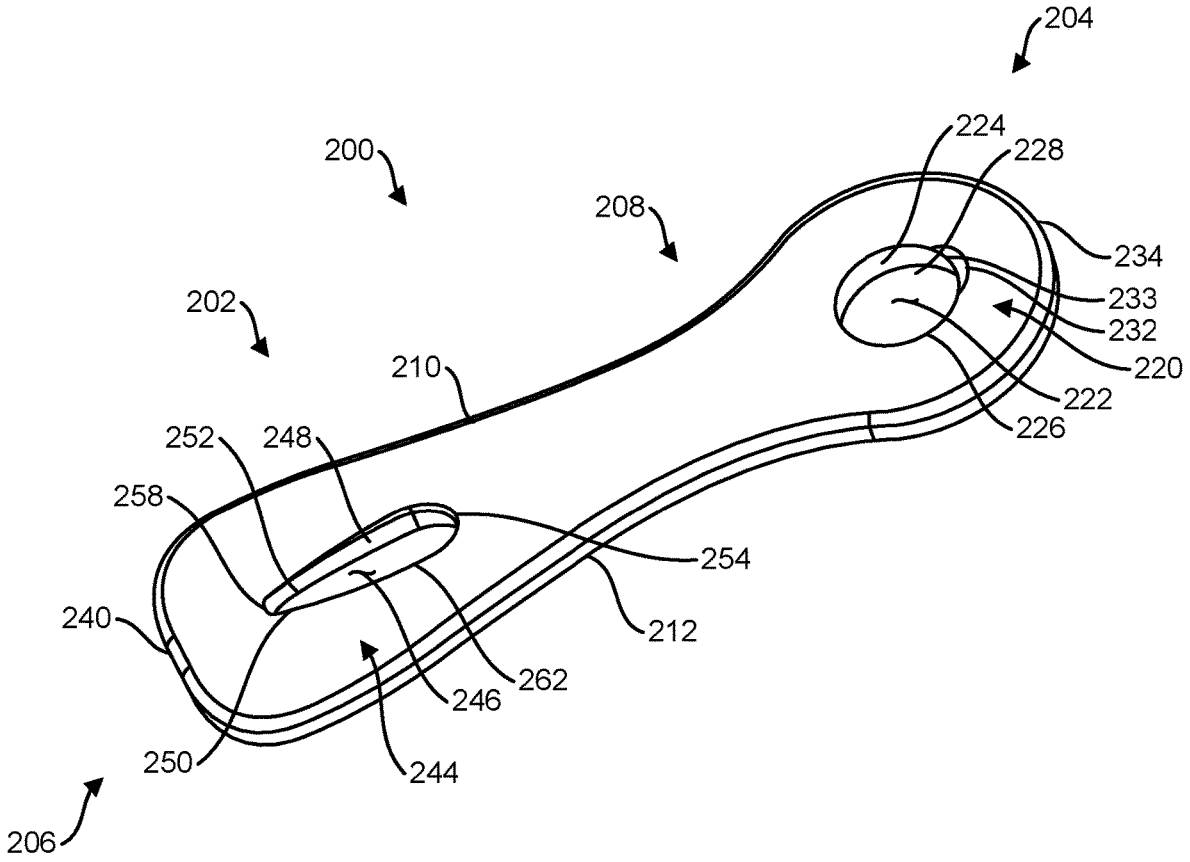
FIG. 7 is a perspective view of another embodiment of the marker opening device containing a plug remover and a nib remover.
Figure 8:
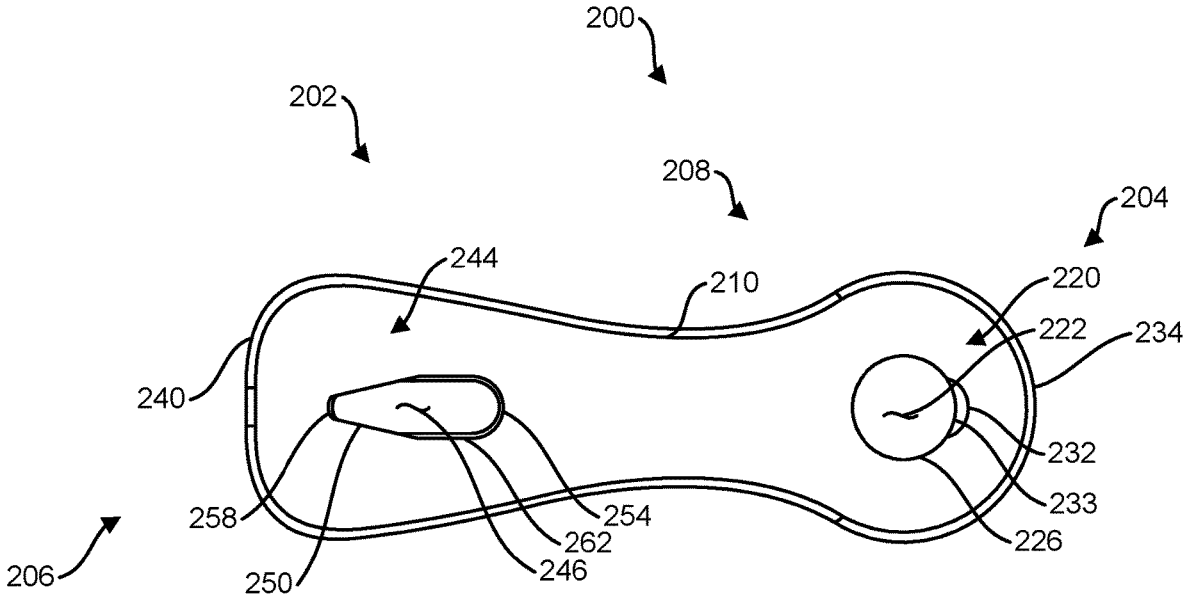
FIG. 8 is a top view of the marker opening device.
Figure 9:
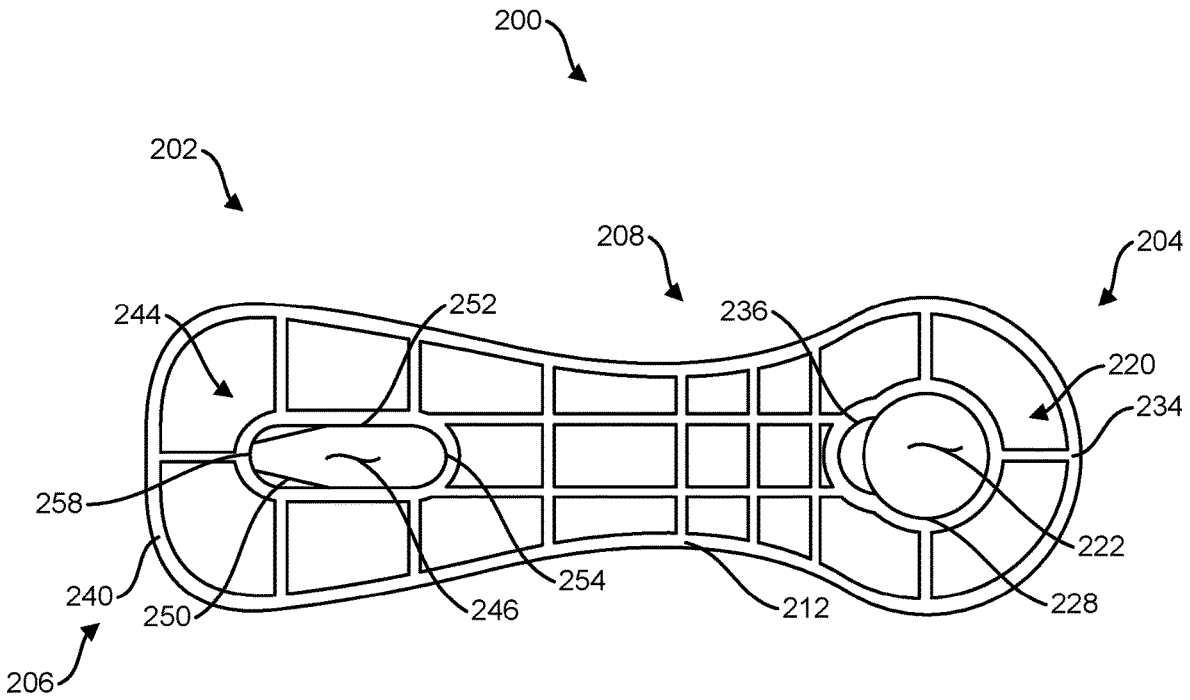
FIG. 9 is a bottom view of the marker opening device.

In use, the plug of the marker (e.g., an outer surface of the plug) is caught on the well. By applying an upward or downward force on one end of the device (e.g., by applying a prying motion to the device), the plug of the marker can be removed from the barrel (FIGS. 5 and 6). That is, the plug remover 120 is configured to receive the plug of the marker therein. When the marker is angled relative to plug remover 120 (or generally to device 100), a portion of the plug is in abutting engagement with a face 135, 137 of one of the upper edge well 132 or lower edge well 136. A portion of the barrel of the marker is in abutting engagement with the face 135, 137 of the other of the upper edge well 132 and the lower edge well 136. As an example, in use, a portion of the plug of the marker is in abutting engagement with the upper edge well 132. The upper portion of the ledge of the plug is in abutting engagement with the interior surface 124, or ideally, the lower surface 112 of device 100 in order to provide leverage on the plug to allow it to be pried off of the barrel of the marker. Upon angling, a portion of the barrel of the marker is in abutting engagement with the lower edge well 134. Lower edge well 134 allows sufficient room for the marker to be angled within opening 122, as well as providing leverage against the plug of the marker.

In various embodiments, particularly in embodiments not including upper edge well 132 and/or lower edge well 136, the plug remover 120 is configured to receive the plug of the marker, and when the marker is angled in the plug remover opening 122 relative to the plug remover 120 (or generally to device 100), a portion of the plug is in abutting engagement with the interior surface 124.

The device 100 can be any shape, as will be understood by the skilled person. In the illustrated embodiment, the first portion 104 of the device 100 generally follows the arc of the opening 122 of the plug remover 120 and the second portion 106 of the device 100 is generally rounded (e.g., arcuate). The intermediate portion 108 of the illustrated embodiment is narrower than (e.g., cinched in) compared to the first and second portions 104, 106.

FIGS. 7 to 11 illustrate another exemplary embodiment of a marker opening device 200 according to the present disclosure. The device 200 is similar to device 100 described above, and corresponding parts are indicated by corresponding reference numbers, plus 100. In this embodiment, the second portion 206 of the device 200 can contain a nib remover 244. The nib remover 244 defines an opening 246, i.e., the opening 246 is defined by an interior surface 224 of the nib remover 244 and contains an upper edge 250 on the upper face 210 of the device 200 and a lower edge 252 on the lower face 212 of the device 200. A first end 254 of the interior surface 224 of the nib remover 244 is generally rounded and the opening 246 is shaped to allow for insertion of the marker nib. The upper edge 250 of the interior surface 248 of the second end 258 of the nib remover 244 contains angled edges so that a diameter of the opening 246 tapers from the first end 254 to the second end 258 of the nib remover 244 on the upper edge 250 of the device 200. The lower edge 252 of the interior surface 248 of the second end 258 of the nib remover 244 is generally rounded and generally constant in diameter. Alternatively, the upper edge 250 can be substantially rounded with the lower edge 252 having angled edges that taper from the first end 254 to the second end 258. The nib remover 244 also optionally contains an intermediate portion 262 having an upper edge 250 and a lower edge 252 that are substantially straight (i.e., the opposing sides of the interior surface 224 are substantially parallel) and an opening 246 with a generally constant diameter. After insertion of the nib of the marker into the first end 254 of the nib remover 244, the user slides the nib to the second end 258 of the nib remover 244 and the nib is caught between the angled surfaces of the upper edge 250 of the interior surface 248 in a narrow portion of the opening that has a width less than the diameter of the nib. Upon application of a downward force (or upward force, as appropriate) on the marker, the nib can be separated from the barrel of the marker.

The opening 246 of nib remover 244 is generally sized and shaped to receive a marker nib. In one embodiment, the opening 246 is sized to receive a number of different sizes (broad line, fine line, super fine line, etc.) and shapes (bullet, brush, chisel, flat, stamp, etc.) of marker nibs. In other embodiments, nib remover 244 contains a plurality of openings (see FIGS. 10 and 11) sized and/or shaped to receive different types and/or sizes of nibs. The opening 246 of nib remover 244 can also be sized to receive the nib of the marker only while not allowing any portion of the barrel to pass therethrough. For example, an opening 246 intended for a broad line marker nib can be approximately 0.32 inches (8.13 millimeters) in diameter at the first end 254. In this manner, because the standard broad line marker barrel diameter is larger than 0.32 inches (8.13 millimeters) and the standard broad line nib diameter is smaller than 0.32 inches (8.13 millimeters), the nib, but not the barrel, is allowed to pass through opening 246. At the second end 258, opening 246 tapers to approximately 0.09 inches (2.29 millimeters) in diameter. In this embodiment, the opening 246 can have an approximate length of 0.65 inches (16.51 millimeters). Other embodiments, however, may allow the marker barrel to pass through opening 246. As another example, an opening 246 of nib remover 244 intended for a fine line marker nib can be approximately 0.2 inches (5.08 millimeters) in diameter at the first end 254. At the second end 258, opening 246 tapers to approximately 0.04 inches (1.02 millimeters) over a 0.5 inch (12.7 millimeter) length. When a SuperTip nib is used in this opening 246, the nib is allowed to pass therethrough (having a diameter of approximately 0.18 inches (4.57 millimeters)), but the barrel of the marker is blocked from passing therethrough.

Figure 11:
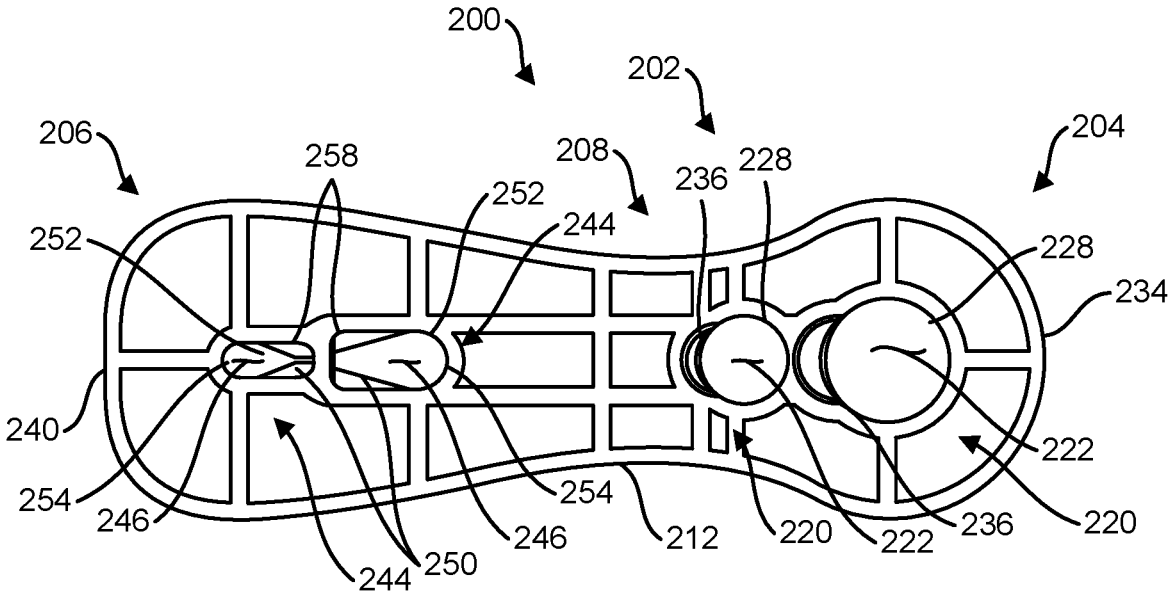
FIG. 11 is a bottom view of the marker opening device.
Figure 12:
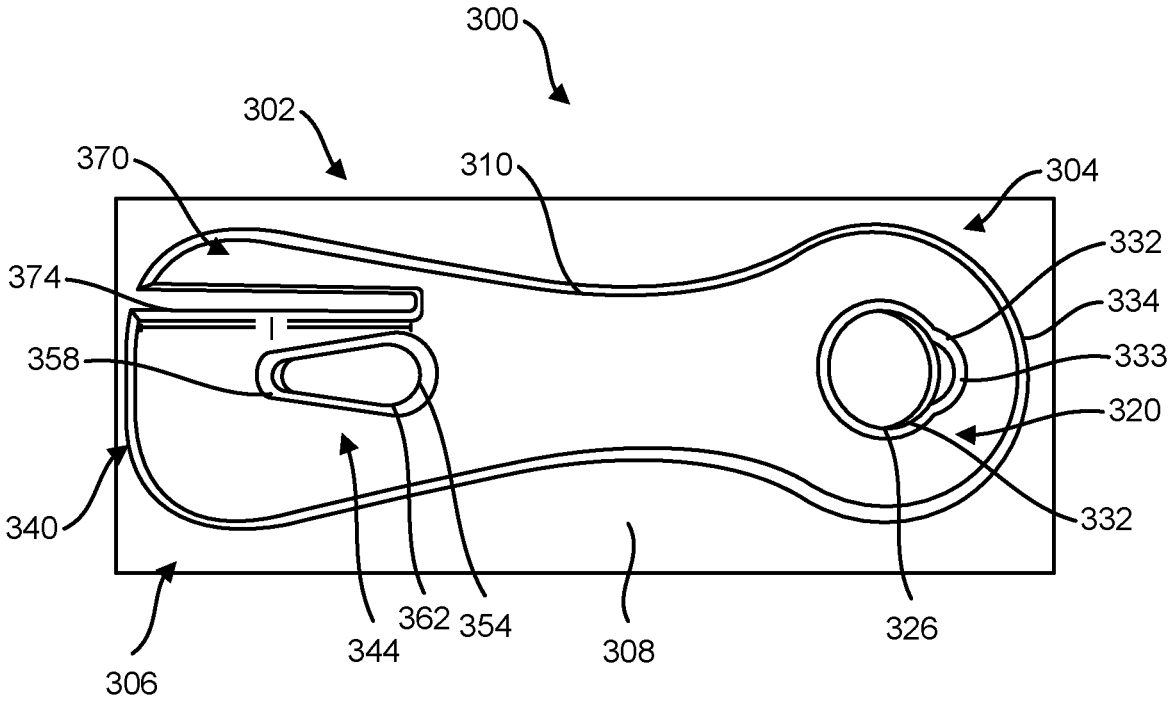
FIG. 12 is a top view of another embodiment of the marker opening device containing a plug remover, a nib remover, and a cartridge remover.
Figure 13:
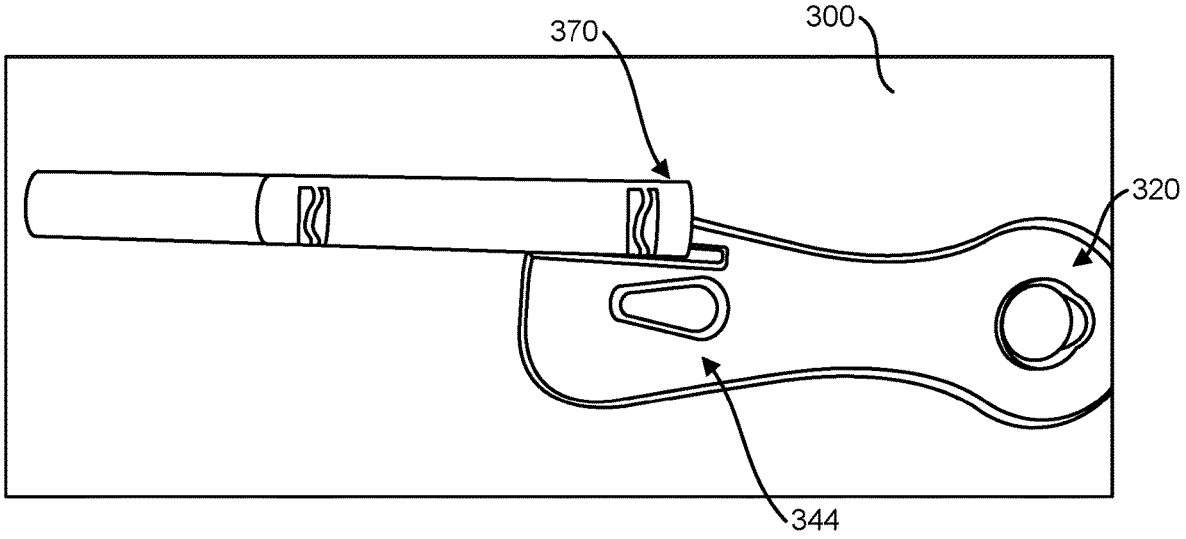
FIG. 13 is an image of a marker inserted in the cartridge remover of the marker opening device.
Figure 14:
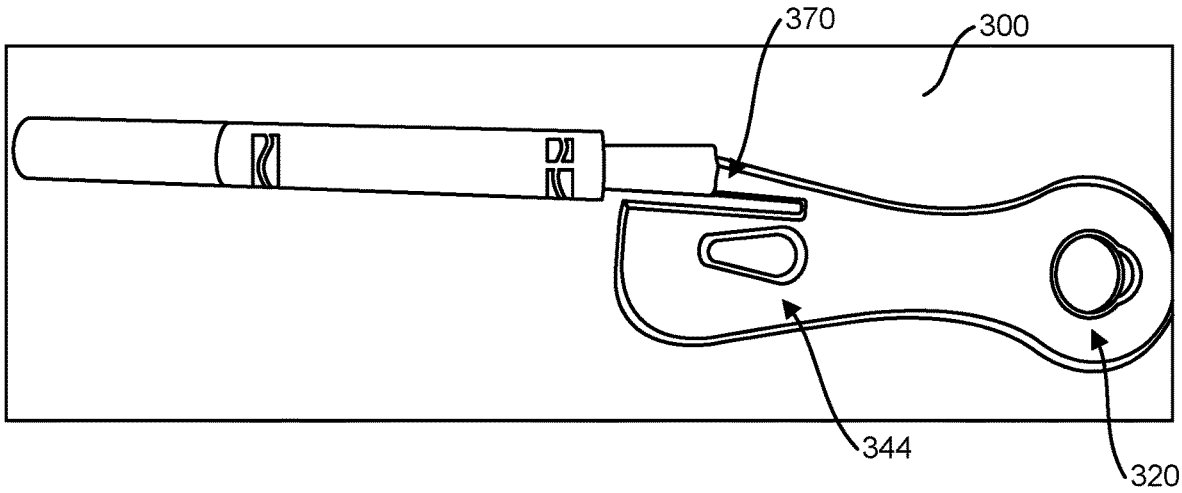
FIG. 14 is an image of a marker being removed from the cartridge remover of the marker opening device.

FIGS. 12 to 14 illustrate another exemplary embodiment of a marker opening device 300 according to the present disclosure. The device 300 is similar to device 200 described above, and corresponding parts are indicated by corresponding reference numbers, plus 100. In this embodiment, the second portion 306 of the device 300 can also include a cartridge remover 370. The cartridge remover 370 generally comprises a slot 374 at the second end 340 of the device 300. The slot 374 is of a length/designed to capture the cartridge of the marker. As will be understood by the skilled person, the length/may differ based on the type of marker intended for use with the device 300 (e.g., the length/of the slot 374 may smaller for devices 300 intended for shorter or travel-sized markers and larger for devices 300 intended for standard sized markers). In various embodiments, the slot 374 is universally sized. In use, the slot 374 of the cartridge remover 370 is slid along the barrel of the marker after the plug has been removed (FIG. 11). The edge of the slot 374 captures (e.g., punctures, pierces) the cartridge and upon removal of the device 300 from the barrel of the marker, the cartridge is also removed (FIG. 12).

Also provided herein is a marker opening kit comprising a plug remover and a nib remover, the plug remover and nib remover being substantially similar to those described above. In general, the plug remover comprises an upper surface, a lower surface, and an interior surface, an opening defined by the interior surface, the opening sized to receive a plug of a marker. The plug remover is configured to receive the plug of the marker, and when the plug is angled in the plug remover opening relative to a longitudinal axis of the plug remover, a portion of the plug is in abutting engagement with the interior surface of the plug remover. The nib remover comprises an upper surface, a lower surface, and an interior surface, and an opening defined by the interior surface, the opening sized to receive a nib of the marker. In the nib remover, at least one of the upper edge of the nib remover opening and a lower edge of the nib remover opening is angled so that a width of the nib remover opening decreases across a length of the nib remover opening.

A method of disassembling a marker for recycling is also provided herein. The method comprises providing a marker opening device as described above, inserting the plug of the marker into the plug remover, angling the marker relative to the body of the marker opening device, and moving the plug remover relative to the plug such that the face of one of the upper edge well and the lower edge well contact the plug to pry the plug off of the body. In various embodiments, the force required to pry the plug off of the body using the marker opening device is less than the force required to pry the plug off of the body without the marker opening device (e.g., manually, with no assisting device). This reduction in required force is provided, in part, by the shape and orientation of the wells in the plug remover opening.

The method can further comprise inserting the nib of the marker into the nib remover opening; sliding the nib along the length of the nib remover opening until the nib is caught between the angled edges of the nib remover opening; and removing the nib from the marker by applying an upward or downward force on the marker.

The cartridge of the marker can also be removed manually or by using the cartridge remover described above. In this way, the method further comprises sliding the barrel of the marker into the slot of the cartridge remover, wherein the slot captures the cartridge inside the barrel of the marker by piercing the cartridge with the edge of the body of the marker opening device; and removing the barrel of the marker from the slot of the cartridge remover.

Having described the invention in detail, it will be apparent that modifications and variations are possible without departing from the scope of the invention defined in the appended claims.

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above products and methods without departing from the scope of the invention, it is intended that all matter contained in the above description and shown in the accompanying drawings shall be interpreted as illustrative and not in a limiting sense.

The invention claimed is:

1. A method of disassembling a marker for recycling, the method comprising:

providing a marker opening device comprising:

a body having an upper surface, a lower surface, and an interior surface, the body including at least one plug remover comprising:

a plug remover opening defined by the interior surface, the plug remover opening sized to receive a plug of a marker; and at least one well at an edge of the plug remover opening defining a well surface;

wherein the plug remover is configured to receive the plug of the marker in the plug remover opening, such that when the marker is angled in the plug remover opening relative to the body of the marker opening device, a portion of an outer surface of the plug is in abutting engagement with at least a portion of the well surface;

inserting the plug of the marker into the plug remover opening in the at least one plug remover;

angling the marker relative to the body of the marker opening device; and moving the plug remover relative to the plug such that one of the upper well surface and the lower well surface contacts the plug to pry the plug off of the marker body.

2. The method of claim 1, wherein the marker opening device further comprises at least one nib remover, the nib remover comprising:

a nib remover opening defined by the interior surface, the nib remover opening sized to receive a nib of the marker;

wherein at least one of an upper edge of the nib remover opening and a lower edge of the nib remover opening has at least one edge portion angled so that a width of the nib remover opening decreases across a length of the nib remover opening to define a narrow portion of the opening having a width less than a diameter of the nib of the marker;

and wherein the method further comprises:

inserting the nib of the marker into the nib remover opening;

sliding the nib along the length of the nib remover opening and toward the narrow portion of the opening until the nib is caught therein; and removing the nib from the marker by applying an upward or downward force on the barrel of the marker.

3. The method of claim 2, wherein at least one edge portion of the upper edge of the nib remover opening is angled to define the narrow portion of the opening.

4. The method of claim 1, wherein the marker opening device further comprises a cartridge remover comprising a slot adjacent to an outer edge of the body;

and wherein the method further comprises:

sliding the barrel of the marker into the slot of the cartridge remover, wherein the slot captures an ink cartridge inside the barrel of the marker by piercing the ink cartridge with the edge of the body;

removing the barrel of the marker from the slot of the cartridge remover.

5. The method of claim 1, wherein the marker opener device comprises an upper edge well at an upper edge of the plug remover opening defining an upper well surface and a lower edge well at a lower edge of the plug remover opening defining a lower well surface, wherein the upper edge well opposes the lower edge well; and wherein angling the marker relative to the body of the marker opening device comprises:

positioning a portion of an outer surface of the plug in abutting engagement with at least a portion of one of the upper well surface and the lower well surface; and positioning a portion of an outer surface of the barrel of the marker is in abutting engagement with at least a portion of the other of the upper well surface and the lower well surface.

6. The method of claim 1, wherein the marker opening device comprises a plurality of plug removers, each of which comprises a plug remover opening defined by the interior surface, wherein each plug remover opening is sized to receive plugs of markers of a different size;

wherein the method comprises the additional step of selecting a plug remover from the plurality of plug removers that has a plug remover opening sized to receive the plug of the marker; and wherein the plug of the marker is inserted into the plug remover opening in the selected plug remover.

7. The method of claim 6, wherein the marker opening device comprises a first plug remover having a plug remover opening sized to receive one of a broad line marker, a fine line marker, and a super fine line marker and a second plug remover having a plug remover opening sized to receive another of a broad line marker, a fine line marker, and a super fine line marker.

8. A method of disassembling a marker for recycling, the method comprising:

providing a marker opening device comprising a body having an upper surface, a lower surface, and an interior surface, the body comprising at least one plug remover and at least one nib remover;

wherein the at least one plug remover comprises a plug remover opening defined by the interior surface, the plug remover opening sized to receive a plug of a marker, wherein the plug remover is configured to receive the plug of the marker in the plug remover opening such that when the marker is angled in the plug remover opening relative to the body of the marker opening device, a portion of the plug is in abutting engagement with the interior surface;

wherein the at least one nib remover comprises a nib remover opening defined by the interior surface, the nib remover opening sized to receive a nib of the marker; and wherein at least one of an upper edge of the nib remover opening and a lower edge of the nib remover opening has at least one edge portion angled so that a width of the nib remover opening decreases across a length of the nib remover opening to define a narrow portion of the opening having a width that is less than a diameter of the nib of the marker;

inserting the plug of the marker into the plug remover;

angling the marker relative to the body of the marker opening device;

moving the plug remover relative to the plug such that the interior surface contacts the plug to pry the plug off of the marker body;

inserting the nib of the marker into the nib remover;

sliding the nib along the length of the nib remover opening and toward the narrow portion of the opening until the nib is caught therein; and removing the nib from the marker by applying an upward or downward force on the body of the marker.

9. The method of claim 8, wherein the marker opening device further comprises cartridge remover comprising a slot adjacent to an outer edge of the body;

and wherein the method further comprises:

sliding the barrel of the marker into the slot of the cartridge remover, wherein the slot captures an ink cartridge inside the barrel of the marker by piercing the ink cartridge with the edge of the body;

removing the barrel of the marker from the slot of the cartridge remover.

10. The method of claim 8, wherein the marker opening device further comprises at least one of an upper edge well at an upper edge of the plug remover opening defining an upper well surface and a lower edge well at a lower edge of the plug remover opening defining a lower well surface, wherein the upper edge well opposes the lower edge well; and wherein angling the marker relative to the body of the marker opening device comprises:

positioning a portion of an outer surface of the plug in abutting engagement with one of the upper well surface and the lower well surface; and positioning a portion of an outer surface of the barrel of the marker is in abutting engagement with the other of the upper well surface and the lower well surface.

11. The method of claim 8, wherein at least one edge portion of the upper edge of the nib remover opening is angled to define the narrow portion of the opening.

12. The method of claim 11, wherein a portion of the lower edge at a first end of the nib remover opening and a portion of the lower edge of a second end of the nib remover opening are substantially rounded.

13. The method of claim 8, wherein the body contains a first portion and a second portion, the first portion comprising the at least one plug remover and the second portion comprising the at least one nib remover.

14. The method of claim 8, wherein the marker opening device comprises at least two nib remover openings defined by the interior surface, wherein a first nib remover opening is sized to receive a nib of a broad line marker, a fine line marker, or a super fine line marker and a second nib remover opening is sized to receive a nib of another of a broad line marker, a fine line marker, or a super fine line marker.

15. The method of claim 14, wherein the method comprises the additional step of selecting a nib remover opening from the at least two nib remover openings, the selected nib remover opening being sized to receive the nib of the marker, wherein the nib of the marker is inserted into the selected nib remover opening.

* * * * *